US009623683B2

(12) United States Patent
Kojima

(10) Patent No.: US 9,623,683 B2
(45) Date of Patent: Apr. 18, 2017

(54) THERMAL PRINTER AND PROGRAM

(71) Applicant: SATO HOLDINGS KABUSHIKI KAISHA, Tokyo (JP)

(72) Inventor: Michitaka Kojima, Saitama (JP)

(73) Assignee: SATO HOLDINGS KABUSHIKI KAISHA (JP)

( * ) Notice: Subject to any disclaimer, the term of this patent is extended or adjusted under 35 U.S.C. 154(b) by 0 days.

(21) Appl. No.: 14/785,967

(22) PCT Filed: Jun. 12, 2013

(86) PCT No.: PCT/JP2013/066160
§ 371 (c)(1),
(2) Date: Oct. 21, 2015

(87) PCT Pub. No.: WO2014/174689
PCT Pub. Date: Oct. 30, 2014

(65) Prior Publication Data

US 2016/0096382 A1 Apr. 7, 2016

(30) Foreign Application Priority Data

Apr. 22, 2013 (JP) ..... 2013-089044

(51) Int. Cl.
*B41J 13/00* (2006.01)
*B41J 2/325* (2006.01)
(Continued)

(52) U.S. Cl.
CPC ..... *B41J 13/0009* (2013.01); *B41J 2/32* (2013.01); *B41J 2/325* (2013.01); *B41J 3/4075* (2013.01); *B41J 11/04* (2013.01); *B41J 11/42* (2013.01)

(58) Field of Classification Search
CPC . B41J 2/32; B41J 11/04; B41J 13/0009; B41J 3/4075; B41J 11/42; B41J 2/325
See application file for complete search history.

(56) References Cited

U.S. PATENT DOCUMENTS 4,422,376 A * 12/1983 Teraoka ..... B65C 9/1865 101/306
8,605,128 B2 12/2013 Masuda
2006/0082638 A1* 4/2006 Sanbongi ..... B41J 2/325 347/213

FOREIGN PATENT DOCUMENTS

JP 10-181123 7/1998
JP 11-20254 1/1999
(Continued)

OTHER PUBLICATIONS

International Search Report dated Jul. 30, 2013 issued in corresponding International patent application No. PCT/JP2013/066160.
(Continued)

*Primary Examiner* — Alessandro Amari
*Assistant Examiner* — Roger W Pisha, II
(74) *Attorney, Agent, or Firm* — Ostrolenk Faber LLP

(57) ABSTRACT

A thermal printer includes a control unit that performs control to perform: an option operation, whereby upon completion of printing on a label provided on a continuous label body, the printed label is conveyed to a particular position and then conveyance of the continuous label body is stopped; and a retraction operation, whereby when a preset permitted stop time period has elapsed since the stop of conveyance of the continuous label body without performing next printing during the permitted stop time period, an unprinted label retracts to a retraction position where at least a printing region of the unprinted label is not sandwiched between a platen roller and a thermal head. The control unit can change the permitted stop time period for each type and/or each width of a label to be printed.

13 Claims, 4 Drawing Sheets

(51) Int. Cl.

| | |
|---|---|
| ***B41J 11/42*** | (2006.01) |
| ***B41J 3/407*** | (2006.01) |
| ***B41J 2/32*** | (2006.01) |
| ***B41J 11/04*** | (2006.01) |

(56) References Cited

FOREIGN PATENT DOCUMENTS

| | | |
|---|---|---|
| JP | 2001-88385 | 4/2001 |
| JP | 2002-104354 | 4/2002 |
| JP | 2002-255139 | 9/2002 |
| JP | 2002-337406 | 11/2002 |
| JP | 2003-170619 | 6/2003 |
| JP | 2004-181887 | 7/2004 |
| JP | 2006-95718 | 4/2006 |
| JP | 2011-104904 | 6/2011 |
| JP | 2011-183656 | 9/2011 |

OTHER PUBLICATIONS

Written Opinion dated Jul. 30, 2013 issued in corresponding International patent application No. PCT/JP2013/066160.

* cited by examiner

THERMAL PRINTER AND PROGRAM

CROSS REFERENCE TO RELATED APPLICATIONS

The present application is a 35 U.S.C. §371 National Phase conversion of PCT/JP2013/066160, filed Jun. 12, 2103, which claims benefit of Japanese Application No. 2013-089044, filed Apr. 22, 2013, the disclosure of which is incorporated herein by reference. The PCT International Application was published in the Japanese language.

TECHNICAL FIELD

The present invention relates to a thermal printer that performs printing with heat generated by a thermal head, and a program.

BACKGROUND ART

Some thermal printers can perform an option operation, such as a tear-off operation and a peeling operation. In the option operation, printed labels are sometimes conveyed to a predetermined position (referred to as an option position) and then stopped after printing has been performed on the designated number of labels. For example, in the tear-off operation, a liner is automatically advanced until a portion of the liner between a printed label and the next unprinted label arrives at the position of a cutter, and then the liner is stopped. In the peeling operation, a liner is automatically advanced until a printed label arrives at a position where it is peeled off, and then the liner is stopped.

A thermal printer performs printing while conveying a label in a state where the label is sandwiched between a thermal head and a platen roller. At this time, a predetermined pressure is applied between the thermal head and the platen roller. Therefore, if the label is left for a long period of time in a state where it is sandwiched between the thermal head and the platen roller, the label may deform, e.g., become dent, depending on its material. This has a possibility of negatively affecting the printing quality, e.g., blurring print on a portion that has deformed.

Patent Literature 1 discloses a technique to prevent deformation of a thermal sheet sandwiched between a thermal head and a platen roller. In a thermal printer of Patent Literature 1, if a state in which no printing is performed lasts for a predetermined time period or longer, a leading end of the thermal sheet retracts to a position which is upstream relative to a print standby position and in which no stress is applied.

CITATION LIST

Patent Literature

Patent Document 1: JP 2011-183656A

SUMMARY OF INVENTION

Technical Problems

A wide variety of materials are used for labels. Different materials bring about a wide range of differences in a time period it takes for the labels to deform when sandwiched between a thermal head and a platen roller. Labels also come in a wide variety of widths, and the load applied per unit area varies with each width. Therefore, different label widths also bring about a wide range of differences in a time period it takes for the labels to deform when sandwiched between the thermal head and the platen roller.

The invention of the aforementioned Patent Literature 1 causes a thermal sheet to retract if a state in which no printing is performed lasts for a predetermined time period or longer. In this case, the predetermined time period could possibly be too long or too short for a label to be used.

If a predetermined time period is set too long, there is a possibility that the label will deform. On the other hand, if a predetermined time period is set too short, a time period for which the label stays at an option position is too short, which gives rise to the problem of reduced usability. In consideration of both usability and prevention of deformation, it is preferable to set the longest possible time period without causing deformation.

However, even if a user knows the material of the label, a time period to be set is unknown. Furthermore, it is also necessary to change the setting of the time period depending on the width of the label to be printed. As a consequence, there has been a problem that it is difficult for the user to appropriately set the time period.

It is an object of the present invention to provide a thermal printer that can prevent deformation of an unprinted label and that achieves excellent usability by enabling a printed label to stop at a predetermined position for a long period of time, as well as a program for such a thermal printer.

Means to Solve Problems

The present invention solves the above-described problems with the following means of solution.

The invention of claim 1 is a thermal printer including a platen roller, a thermal head, and a control unit. The thermal head performs printing on a continuous label body while the platen roller is rotating. The control unit performs control such that the platen roller and the thermal head perform: an operation to move to a particular position, whereby upon completion of printing on a label provided on the continuous label body, the printed label is conveyed to the particular position and then conveyance of the continuous label body is stopped; and a retraction operation, whereby when a preset permitted stop time period has elapsed since the stop of the conveyance of the continuous label body without performing next printing during the permitted stop time period, an unprinted label retracts to a retraction position where at least a printing region of the unprinted label is not sandwiched between the platen roller and the thermal head. The control unit can change the permitted stop time period for each type and/or each width of a label to be printed.

The invention of claim 2 is the thermal printer according to claim 1, wherein the control unit receives or reads in a type and/or a width of a label to be used in printing, and/or a setting of the permitted stop time period.

The invention of claim 3 is the thermal printer according to claim 1 or 2 further including an operation unit, wherein when an operation has been performed via the operation unit, the control unit brings the unprinted label from the retraction position back to the particular position.

The invention of claim 4 is the thermal printer according to any one of claims 1 to 3, wherein the retraction position is a position where printing on the unprinted label positioned next to the printed label can be started, and when the control unit receives next printing data while the unprinted label is at the retraction position, the control unit starts printing in a state where the unprinted label is at the retraction position.

The invention of claim 5 is the thermal printer according to any one of claims 1 to 4, wherein the control unit can change the permitted stop time period in accordance with applied pressure between the thermal head and the platen roller.

The invention of claim 6 is a program for controlling a thermal printer including a platen roller and a thermal head that performs printing on a continuous label body while the platen roller is rotating. The program causes a computer to function as control means that controls the platen roller and the thermal head to: upon completion of printing on one of labels provided on the continuous label body, convey the printed label to a particular position and then stop conveyance of the continuous label body; and when a preset permitted stop time period has elapsed since the stop of the conveyance of the continuous label body without performing next printing during the permitted stop time period, cause an unprinted label to retract to a retraction position where at least the unprinted label is not sandwiched between the platen roller and the thermal head.

Advantageous Effects of Invention

By using the thermal printer and the program therefor according to the present invention, deformation of an unprinted label can be prevented, and usability is improved as a printed label can stop at a predetermined position for a longer period of time.

DESCRIPTION OF EMBODIMENTS

The following describes the best modes for carrying out the present invention with reference to the drawings and the like.

First Embodiment

Figure 1:
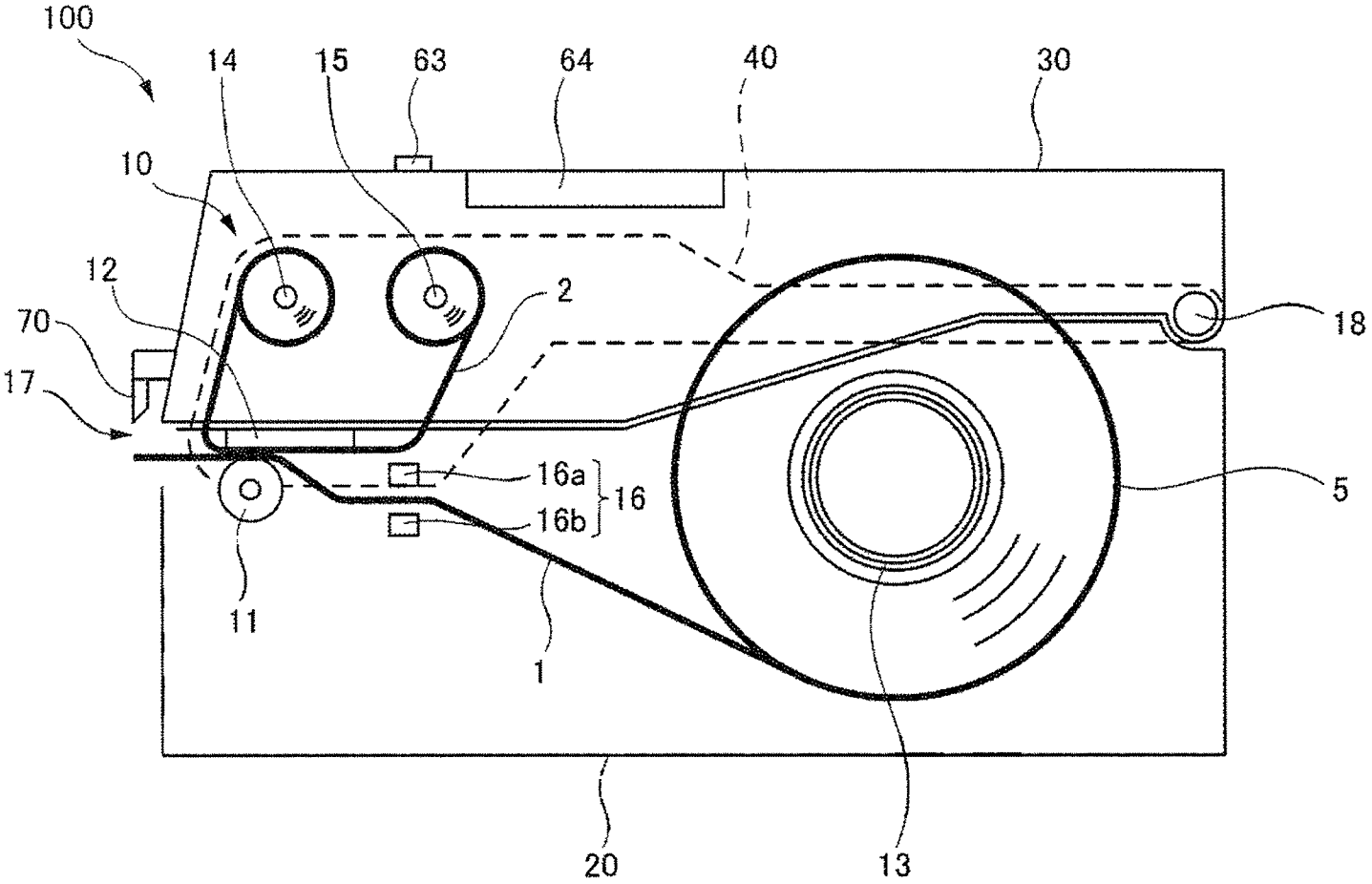
FIG. 1 is a schematic side view showing a configuration of a thermal printer 100 according to a first embodiment of the present invention.

FIG. 1 is a schematic side view showing a configuration of a thermal printer 100 according to a first embodiment of the present invention. It should be noted that each of the figures discussed below, including FIG. 1, is a schematic illustration in which the size and shape of each component are exaggerated as appropriate to facilitate the understanding. Furthermore, although specific numerical values, shapes, materials, and the like are presented in the following description, they can be changed as appropriate. In addition, in the present specification and the claims, output of various types of information by a thermal printer is expressed as "printing", which is a common practice among those skilled in the art. It should be noted that, as just stated, the expression "printing" refers to output of information by a thermal printer. It will be assumed that the expression "printing" is not limited to the output of characters, and has a broad meaning including the output of graphics (e.g., a barcode), images, and the like.

The thermal printer 100 according to the present embodiment includes a printing unit 10 provided with a platen roller 11 and a thermal head 12. The platen roller 11 is connected to a stepper motor 53 (see FIG. 2) via a non-illustrated timing belt. The platen roller 11 is rotated and driven through driving of the stepper motor 53. In the thermal head 12, a heat generator unit is arranged so as to oppose the platen roller 11. A plurality of heat generators are formed, along a width direction, in the heat generator unit. The heat generator unit touches a continuous label body 1 in a state where the continuous label body 1 is sandwiched between the heat generator unit and the platen roller 11. In addition, pressure toward the platen roller 11 is applied to the thermal head 12.

In the thermal printer 100, the continuous label body 1 and an ink ribbon 2 are sandwiched and conveyed, in a stacked state, between the platen roller 11 and the thermal head 12. The continuous label body 1 is made by tentatively attaching a plurality of labels to a belt-like liner at a predetermined interval. The thermal printer 100 then transfers ink from the ink ribbon 2 onto the continuous label body 1 to perform printing by selectively causing the heat generators of the thermal head 12 to generate heat while the continuous label body 1 and the ink ribbon 2 are sandwiched and conveyed. Although the present embodiment has been described using an example in which the ink ribbon 2 is used, no limitation is intended in this regard. The present embodiment may adopt a thermal printer that uses a label(s) provided with a thermo-sensitive coloring layer, and thus performs printing without using an ink ribbon.

The continuous label body 1 is rotatably supported as a rolled sheet 5 by a feeding unit 13 in a state where the continuous label body 1 is wound in a roll around a tubular body, such as a paper tube. The feeding unit 13 feeds the continuous label body 1 between the platen roller 11 and the thermal head 12. The ink ribbon 2 is suspended between a ribbon roll-up shaft 14, which is rotated and driven in coordination with the platen roller 11, and a ribbon feeding shaft 15. The ink ribbon 2 supported in a state where it is wound in a roll around the ribbon feeding shaft 15 is fed, together with the continuous label body 1, between the platen roller 11 and the thermal head 12. After transfer, the ink ribbon 2 is rolled up by the ribbon roll-up shaft 14.

A pitch sensor 16 composed of a light emitting element 16*a* and a light receiving element 16*b* is arranged on a conveyance path for the continuous label body 1 from the feeding unit 13 to the printing unit 10. The thermal printer 100 controls printing timing in accordance with the result of detection by the pitch sensor 16. The thermal printer 100 controls printing timing by causing the pitch sensor 16 to detect the leading ends of the labels, cutouts formed on the belt-like liner at the same pitch as the labels, and the like.

Although the pitch sensor 16 has been described as a light transmissive sensor in the present embodiment, it may be a light reflective sensor in which a light emitting unit emits light, a light receiving unit receives the light reflected by the continuous label body 1, and an electrical signal corresponding to the intensity of the received light (the amount of light received per unit time) is output. In this case, the pitch sensor 16 can detect a non-illustrated reference mark that is formed on the continuous label body 1 through printing and the like, on the basis of the amount of light received by the light receiving unit.

The thermal printer according to the present embodiment is composed of a main body unit 20, a top cover unit 30, and a printing unit 40. The platen roller 11 and the feeding unit 13 are arranged in the main body unit 20. The main body unit 20 is exposed at the top. The top cover unit 30 is configured to cover the top of the main body unit 20. The thermal head 12, the ribbon roll-up shaft 14, and the ribbon feeding shaft 15 are arranged in the printing unit 40. The printing unit 40 is arranged between the main body unit 20 and the top cover unit 30. The top cover unit 30 and the printing unit 40 are pivotably supported by a support shaft 18 provided at the back side (right side in FIG. 1) of the main body unit 20. The top cover unit 30 and the printing unit 40 are configured to open from the front side (left side in FIG. 1) where an outlet 17, from which printed labels are discharged, is provided. In addition, an operation unit 63 and a display unit 64 are provided on a top surface of the top cover unit 30.

A cutter 70, which is provided in the vicinity of the outlet 17, is a simple cutter having a cutting blade facing downward. In a tear-off operation, the liner to which a printed label(s) is tentatively attached can be cut off by a user pulling up the continuous label body toward the cutter 70. It should be noted that cutting is not limited to being performed through a manual operation. It is possible to adopt a configuration in which a driving source for driving the cutter 70 is provided, and the liner to which a printed label(s) is tentatively attached is cut off through transmission of a command from the operation unit 63 or a computer 80.

Figure 2:
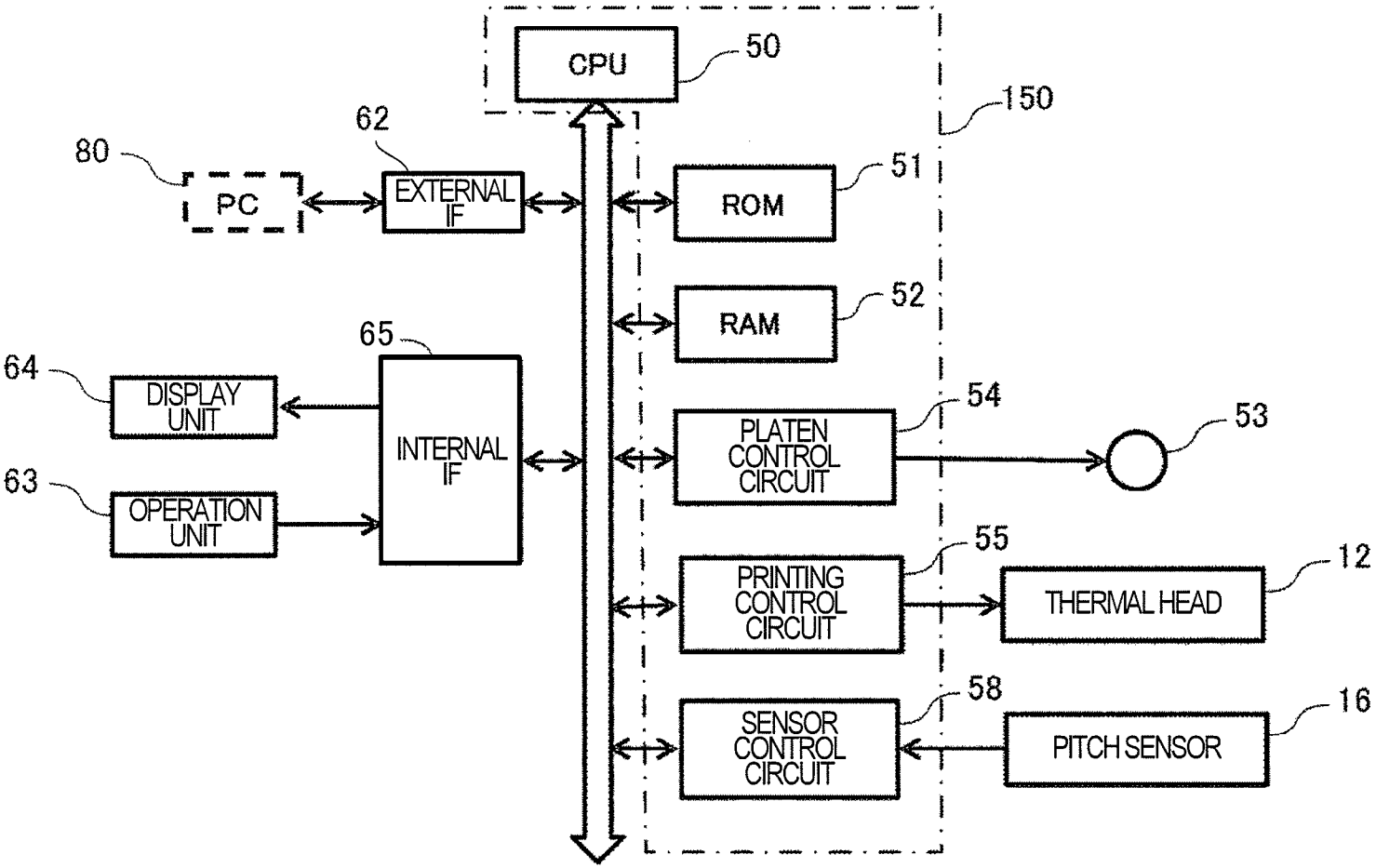
FIG. 2 is a schematic block diagram showing an example of a configuration of the thermal printer 100.

FIG. 2 is a schematic block diagram showing an example of a configuration of the thermal printer 100. The thermal printer 100 includes a central processing unit (CPU) 50, a read-only memory (ROM) 51, a random-access memory (RAM) 52, the stepper motor 53, a platen control circuit 54, a printing control circuit 55, a sensor control circuit 58, an external interface (external IF) 62, the operation unit 63, the display unit 64, and an internal interface (internal IF) 65.

The CPU 50 operates in accordance with various types of control programs stored in the ROM 51, and performs overall control of components including the platen control circuit 54, the printing control circuit 55, the sensor control circuit 58, the operation unit 63, the display unit 64, etc. It should be noted that in the present embodiment, the CPU 50, the ROM 51, the RAM 52, the platen control circuit 54, the printing control circuit 55, and the sensor control circuit 58 constitute a control unit 150 of the thermal printer 100. The platen control circuit 54, the printing control circuit 55, and the sensor control circuit 58 that constitute the control unit 150 will be described as components separate from the CPU 50. Alternatively, in one or more embodiments, any or all of the platen control circuit 54, the printing control circuit 55, and the sensor control circuit 58 may be realized as processing of a computer program(s) executed by the CPU 50.

The ROM 51 stores a printer control program, various types of fixed data, control table data, an IO constant, a motor control program, etc.

The RAM 52 has a working area for storing various types of data that are necessary for the CPU 50 to operate, a printing deployment area to which printing data is deployed, etc.

The stepper motor 53 conveys and drives the continuous label body 1 in a transport direction (forward direction, that is to say, direction from an upstream side to a downstream side) or a reverse direction by causing the platen roller 11 to rotate via a non-illustrated timing belt and the like.

The platen control circuit (conveyance control unit) 54 controls the rotation of the platen roller 11, as well as the conveyance of the continuous label body 1 undergoing printing, by controlling the stepper motor 53.

Under control by the CPU 50, the printing control circuit (printing control unit) 55 generates a control signal corresponding to printing data deployed to the printing deployment area of the RAM 52. The printing data pertains to characters, symbols, barcodes, and the like to be printed. The printing control circuit 55 then feeds the generated control signal to the thermal head 12, thereby controlling operation of the thermal head 12 undergoing printing.

Under control by the CPU 50, the sensor control circuit 58 controls the light emitting element 16*a* of the pitch sensor 16 to emit light, receives an electrical signal output from the light receiving element 16*b*, converts the electrical signal into digital data, and feeds the digital data as printing reference position data to the CPU 50.

Under control by the CPU 50, the external interface (external IF) 62 receives a signal input from the external computer (PC) 80.

The operation unit 63 is composed of, for example, a button(s) for inputting various types of data and commands.

The display unit 64 is composed of, for example, a liquid crystal display apparatus that displays data from the CPU 50. It should be noted that, with the use of a touchscreen, the display unit 64 may be composed of an operation unit and a display unit that are formed in an integrated manner.

The internal interface (internal IF) 65 connects the operation unit 63 and the display unit 64 to the CPU 50.

Figure 3:
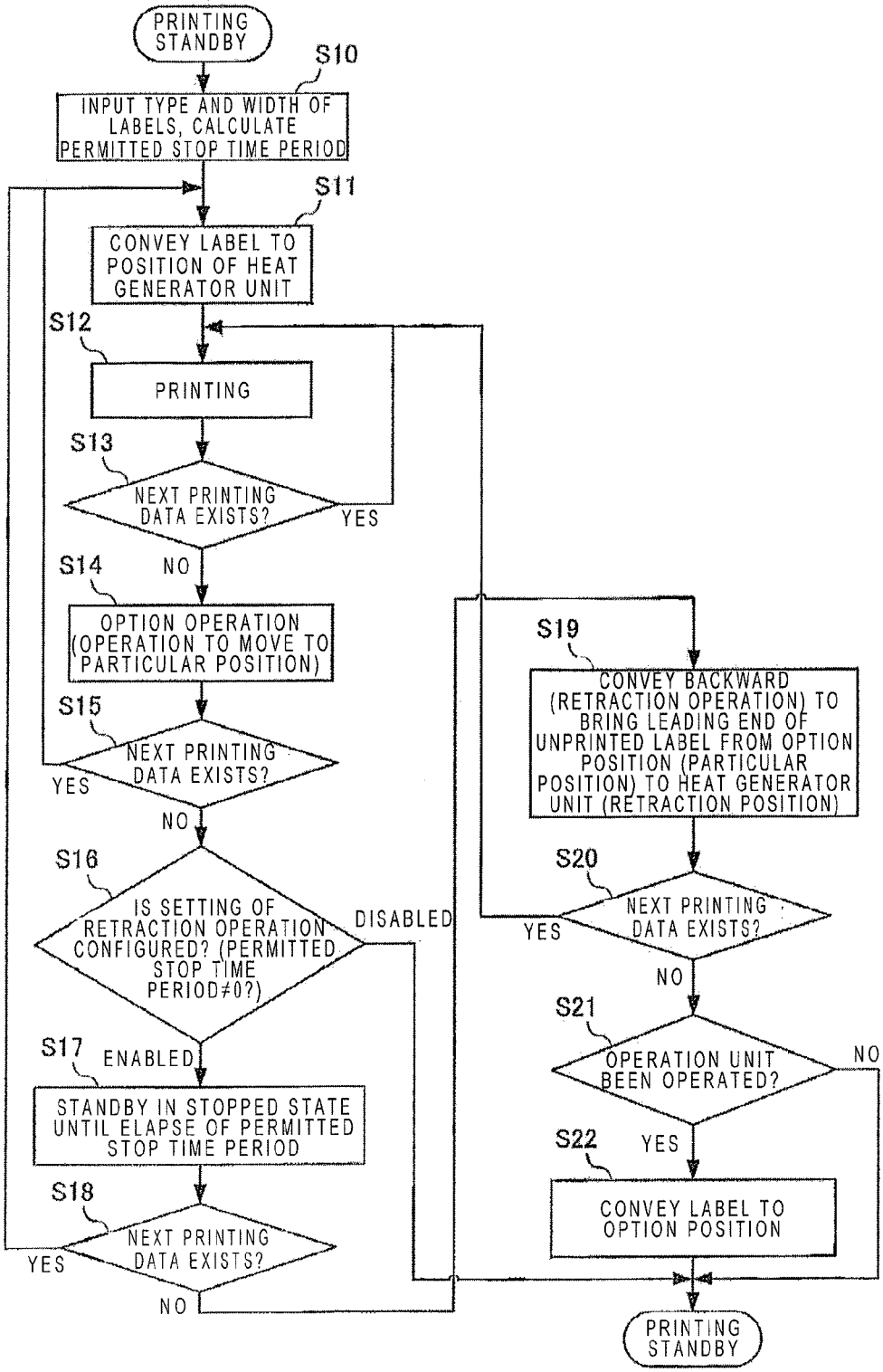
FIG. 3 is a schematic flowchart of operations of the thermal printer 100 according to the present embodiment, involving an option operation and a retraction operation.

The thermal printer 100 according to the present embodiment can perform a tear-off operation as an option operation. The thermal printer 100 according to the present embodiment can also perform a retraction operation for preventing deformation of an unprinted label that is in a stopped state due to the tear-off operation. The following describes such operations. FIG. 3 is a schematic flowchart of operations of the thermal printer 100 according to the present embodiment, involving the option operation and the retraction operation. It will be assumed that the operations of the flowchart shown in FIG. 3 are performed by the thermal printer 100 under control by the control unit 150, unless particularly stated otherwise. FIGS. 4A to 4D are schematic diagrams illustrating the positions of labels in the retraction operation. The continuous label body 1 is made by tentatively attaching labels 4 (4-1, 4-2, 4-3, and so on), which are continuously lined up, to a liner 3. It should be noted that the label 4-2 (No. 2) in FIGS. 4A to 4D is hatched to facilitate understanding.

In step (hereinafter indicated as S) 10 of FIG. 3, input of the type and width of the labels 4 is received or read in. For example, the type (name or symbol) and width of the labels may be indicated on a packing material for packing the rolled sheet 5 or on the paper tube of the rolled sheet 5, in which case the user may input the type and width using the operation unit 63. Alternatively, such information may be encoded in, for example, a barcode and the encoded information may be indicated on the packing material or the paper tube of the rolled sheet 5, in which case the encoded information may be read in by a barcode reader. Alternatively, a symbol or a code that contains information indicating both the type and width of the labels may be used.

The control unit 150 calculates a permitted stop time period in the retraction operation from the obtained information indicating the type and width of the labels. Specifically, for each label type, a permitted stop time period per unit width is stored in a storage unit, that is to say, a nonvolatile area of the ROM 51 or the RAM 52. The control unit 150 reads out a permitted stop time period per unit width corresponding to the obtained label type, and computes a permitted stop time period to be actually set on the basis of the obtained information indicating the label width. In a case where the labels are made of a material that does not cause the labels to deform, or does not practically affect printing even if the labels have deformed, the permitted stop time period is set to zero, meaning that the retraction operation is unnecessary (disabled). The permitted stop time period is also set to zero in a case where the retraction operation is disabled by operating the operation unit 63. It should be noted that, in a case where the user has directly input a permitted stop time period, the control unit 150 conforms to the setting thereof.

In S11, a leading end of an unprinted label 4 is conveyed to the position of the heat generator unit of the thermal head 12. Here, by saying that the leading end of the label 4 is at the position of the heat generator unit, it means that the leading end of the label 4 is at a printing start position from which printing can be started, and it does not require contact between the heat generator unit and the label 4.

In S12, various types of information, such as a barcode and a product name, are printed on the unprinted label 4.

In S13, whether or not next printing data exists is determined. If the next printing data exists, the processing returns to S12. If the next printing data does not exist, the processing proceeds to S14.

In S14, the option operation is performed. The option operation is an operation that can be selected as an addition to a normal printing operation. The option operation according to the present embodiment is an operation to move to a particular position. In this operation to move to the particular position, upon completion of printing on a label provided on the continuous label body, the printed label is conveyed to the particular position, and then the conveyance of the continuous label body is stopped. Specifically, in the present embodiment, a tear-off operation is performed as the option operation (the operation to move to the particular position). The tear-off operation is an operation to automatically advance the continuous label body 1 until a portion of the liner between the printed label and the next unprinted label arrives at the position of the cutter 70, and then stop the continuous label body 1 upon the arrival. In a case where the setting is configured to perform this tear-off operation, the printed label is automatically advanced to the position where it can be cut off by the cutter 70. In this way, the user can perform cutting at a predetermined position simply by pinching and pulling up the printed label, and thus convenience is improved. It should be noted that the operation unit 63 may be operated so as not to perform the option operation. However, in the description of the present embodiment, the setting is configured to perform the option operation.

Figure 4:
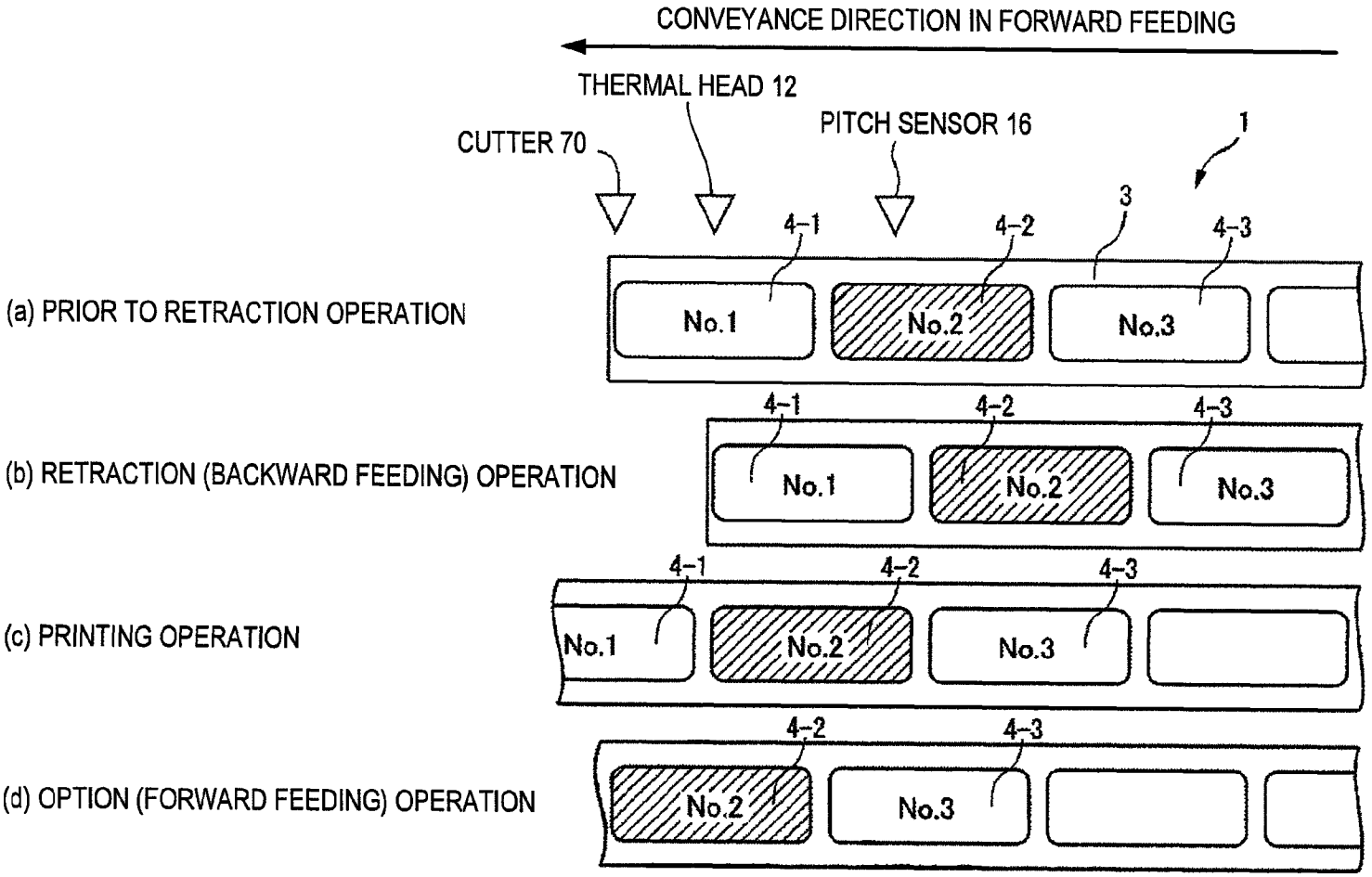
FIGS. 4A to 4D are schematic diagrams illustrating the positions of labels in the retraction operation.

Depending on the length of used labels along a conveyance direction, there is a case in which an unprinted label remains sandwiched between the platen roller 11 and the thermal head 12 on a continuous label body that is in a stopped state due to the tear-off operation. FIG. 4A shows a state in which an unprinted label is sandwiched between the platen roller 11 and the thermal head 12 while in a stopped state due to the tear-off operation. The label No. 1, or 4-1, is at the position of the thermal head 12 and thus sandwiched between the platen roller 11 and the thermal head 12. Although the illustration indicates that a printed label has already been cut off by the cutter 70, the printed label may not be cut off yet, that is to say, may be in a connected state.

In S15, whether or not next printing data exists is determined. If the next printing data exists, the processing returns to S11. If the next printing data does not exist, the processing proceeds to S16.

In S16, whether or not setting of the retraction operation has been configured is checked. Specifically, whether the setting of the retraction operation has been configured is checked on the basis of whether the permitted stop time period calculated by the control unit 150 in S10 satisfies the following relationship: the permitted stop time period≠0. If the permitted stop time period=0, the retraction operation is determined to be unnecessary (disabled), and the operations of the present flow are ended, thereby entering a printing standby state. On the other hand, if the permitted stop time period≠0, that is to say, if some sort of time period is set, it means that the retraction operation is enabled, i.e., the retraction operation needs to be performed, and thus the processing proceeds to S17.

In S17, the stopped state due to the tear-off operation is maintained, while on standby, until elapse of the permitted stop time period computed in S10. Upon elapse of the permitted stop time period, the processing proceeds to S18.

In S18, whether or not next printing data exists is determined. If the next printing data exists, the processing returns to S11. If the next printing data does not exist, the processing proceeds to S19.

In S19, the retraction operation is performed, that is to say, conveyance is performed in the reverse direction so as to bring a leading end of an unprinted label from an option position back to the heat generator unit. As shown in FIG. 4A, when the unprinted label 4-1 is stopped short of the option position due to the tear-off operation, the unprinted label 4-1 is at the position where a printing region thereof is in contact with the heat generator unit of the thermal head 12. If this situation lasts for a long period of time, there is a possibility that the printing region of the label deforms. In view of this, in the present embodiment, the retraction operation is performed in the present step, that is to say, the continuous label body 1 is conveyed backward (backward feeding) so as to bring the leading end of the unprinted label to the printing start position, i.e., the position of the heat generator unit. FIG. 4B shows a state in which the retraction operation has been performed. The retraction operation can prevent deformation of the printing region of the unprinted label.

In S20, whether or not next printing data exists is determined. If the next printing data exists, the processing returns to S11. If the next printing data does not exist, the processing proceeds to S19.

In S21, whether the operation unit 63 has been operated is determined. When the operation unit 63 has been operated, the user has the intention to use the thermal printer 100. In the present embodiment, whether a printed label has already been cut off is not checked before performing the retraction operation. Therefore, there is a possibility that the printed label is not cut off yet, that is to say, is still connected. Furthermore, the retraction operation may be performed when the permitted stop time period has elapsed because, for example, the user left the site after issuing a previous printing instruction. In this case, there is a high possibility that the printed label is not cut off yet, that is to say, is still connected. In view of the above, in the present embodiment, whether the operation unit 63 has been operated is checked in the present step. If the operation unit 63 has been operated, the processing proceeds to S22, and the continuous label body 1 is conveyed again toward the option position. On the other hand, if the operation unit 63 has not been operated, the operations of the present flow are ended, thereby entering a printing standby state.

In S22, the continuous label body 1 is conveyed again toward the option position. Consequently, in a case where the printed label is still connected, the printed label proceeds to the position of the cutter 70, and the leading end of the unprinted label moves from the heat generator unit. As a result, the printing region of the unprinted label moves to the position of the heat generator unit (the state shown in FIG. 4A). After the operation of S22, the operations of the present flow are ended, thereby entering a printing standby state.

For example, if the next printing data exists after the execution of the above-described S22, the present flow is carried out from the beginning. In this case, the state of FIG. 4C immediately follows the printing performed in S12. The state of FIG. 4D immediately follows the execution of subsequent S14 (the execution of the option operation, that is to say, a forward feeding operation).

As described above, in the present embodiment, the control unit 150 automatically calculates the optimal permitted stop time period from the type and width of labels, and performs the retraction operation upon elapse of the calculated permitted stop time period. Therefore, the thermal printer 100 according to the present embodiment can change the permitted stop time period for each type and each width of labels to be printed. This enables easy setting of the optimal, longest possible permitted stop time period that can prevent deformation of the labels, without impairing ease of use by setting too short of a permitted stop time period, and without causing deformation of the labels by setting too long of a permitted stop time period. Thus, the thermal printer 100 according to the present embodiment can prevent deformation of an unprinted label, and achieves excellent usability as it enables a printed label to stop at a predetermined position for a long period of time.

Second Embodiment

The thermal printer 100 according to a second embodiment is similar to the thermal printer 100 according to the first embodiment, except that the configuration of the thermal head 12 and the operations of the control unit 150 partially differ between the first embodiment and the second embodiment. Therefore, the components that fulfil functions similar to the functions of the above-described first embodiment are given the same reference numerals, and a redundant description is omitted as appropriate.

The thermal head 12 according to the second embodiment is configured such that it can adjust pressure applied to the platen roller 11. The thermal head 12 may adjust applied pressure using any method, including various types of methods that are conventionally known. In addition, in the thermal printer 100 according to the present embodiment, the control unit 150 can be informed of a value at which the current applied pressure is adjusted using, for example, an encoder provided to an adjustment scale or a sensor (load cell or strain gauge) that directly measures applied pressure.

The control unit 150 calculates a permitted stop time period in a retraction operation from obtained information indicating the type and width of labels, similarly to the first embodiment. Here, in the second embodiment, the control unit 150 can change the permitted stop time period in accordance with applied pressure between the thermal head 12 and the platen roller 11. Specifically, the permitted stop time period calculated in S10 of FIG. 3 is multiplied by a coefficient corresponding to applied pressure obtained in the above-described manner. For example, when applied pressure is 1.2 times a standard value, the permitted stop time period calculated in S10 is multiplied by 1/1.2=0.83, and the resultant product is used as a permitted stop time period based on the applied pressure. It should be noted that this computation is an example. Computation other than simply giving inverse proportionality to applied pressure may be carried out.

As described above, the second embodiment uses a permitted stop time period based on applied pressure. In this way, even if applied pressure has been changed through adjustment, the thermal printer 100 can prevent deformation of an unprinted label, and achieve excellent usability as it enables a printed label to stop at a predetermined position for a long period of time.

Modified Embodiments

Rather than being limited to the above-described embodiments, a wide variety of modifications and changes are possible. Such modifications and changes are included within a scope of the present invention.

Each embodiment has been described using an example in which the control unit 150 obtains a permitted stop time period through calculation. However, no limitation is intended in this regard. For example, instead of being calculated, a permitted stop time period may be selected from a data table prestored in the ROM 51 and the like. Alternatively, a permitted stop time period that has been calculated or selected by the externally-connected computer 80 may be received.

Each embodiment has been described using an example in which a tear-off operation is performed as an option operation. However, no limitation is intended in this regard. Any operation that causes a printing region of an unprinted label to stop while being sandwiched between the thermal head and the platen roller may be regarded as an option operation.

It should be noted that the embodiments and modified embodiments can be implemented in combination as appropriate. A detailed description of such implementation is omitted. The above-described embodiments shall not limit the present invention.

REFERENCE SIGNS LIST

1 continuous label body
2 ink ribbon
3 liner
4 label
5 rolled sheet
10 printing unit
11 platen roller
12 thermal head
13 feeding unit
14 ribbon roll-up shaft
15 ribbon feeding shaft
16 pitch sensor
16*a* light emitting element
16*b* light receiving element
17 outlet
18 support shaft
20 main body unit
30 top cover unit
40 printing unit
50 CPU
51 ROM
52 RAM
53 stepper motor
54 platen control circuit
55 printing control circuit
58 sensor control circuit
63 operation unit

64 display unit
70 cutter
80 computer
100 thermal printer
150 control unit

The invention claimed is:

1. A thermal printer, comprising:

a platen roller;

a thermal head printing on a label provided on a continuous label body; and a control unit configured to control the platen roller and the thermal head to convey the continuous label body to a particular position upon completion of printing on the label provided on the continuous label body, and to retract the continuous label body from the particular position to a retraction position when a preset permitted stop time period has elapsed since the continuous label body being conveyed to the particular position without performing subsequent printing during the permitted stop time period, wherein the retraction position is a position that at least a printing region of the unprinted label is not sandwiched between the platen roller and the thermal head, and wherein the control unit is configured to change the permitted stop time period.

2. The thermal printer according to claim 1, wherein the permitted stop time period is changed for each type and/or each width of a label to be printed.

3. The thermal printer according to claim 1, wherein the permitted stop time period is changed by direct input from a user.

4. The thermal printer according to claim 1, further comprising a cutter for cutting off, through a manual operation, the printed label conveyed to the particular position.

5. The thermal printer according to claim 1, wherein the control unit receives or reads in input of a type and/or a width of a label to be used in printing, and/or input of the permitted stop time period.

6. The thermal printer according to claim 1, further comprising an operation unit, wherein when an operation has been performed via the operation unit, the control unit brings the unprinted label from the retraction position back to the particular position.

7. The thermal printer according to claim 1, wherein the retraction position is a position where printing on the unprinted label positioned next to the printed label is started, and when the control unit receives the next printing data while the unprinted label is at the retraction position, the control unit starts printing in a state where the unprinted label is at the retraction position.

8. The thermal printer according to claim 1, wherein the control unit is configured to change the permitted stop time period in accordance with applied pressure between the thermal head and the platen roller.

9. A control method for a thermal printer including a platen roller and a thermal head, the thermal head printing on a label provided on a continuous label body, the control method comprising controlling the platen roller and the thermal head to convey the continuous label body to a particular position upon completion of printing on the label provided on the continuous label body, and to retract the continuous label body from the particular position to a retraction position when a preset permitted stop time period has elapsed since the continuous label body being conveyed to the particular position without performing subsequent printing during the permitted stop time period, wherein the retraction position is a position that at least a printing region of the unprinted label is not sandwiched between the platen roller and the thermal head, and wherein the control method further comprises changing the permitted stop time period.

10. The control method for the thermal printer according to claim 9, wherein the permitted stop time period is changed for each type and/or each width of a label to be printed.

11. The control method for the thermal printer according to claim 9, wherein the permitted stop time period is changed by direct input from a user.

12. The control method for the thermal printer according to claim 9, further comprising cutting off, through a manual operation using a cutter, the printed label conveyed to the particular position.

13. A non-transitory computer-readable medium storing therein a program executable by a computer of a thermal printer, the thermal printer including a platen roller and a thermal head, the thermal head printing on a label provided on a continuous label body, and the program including a step of causing the computer to control the platen roller and the thermal head to convey the continuous label body to a particular position upon completion of printing on the label provided on the continuous label body, and retract the continuous label body from the particular position to a retraction position when a preset permitted stop time period has elapsed since the continuous label body being conveyed to the particular position without performing subsequent printing during the permitted stop time period, wherein the retraction position is a position that at least a printing region of the unprinted label is not sandwiched between the platen roller and the thermal head, and wherein the program further includes a step of causing the computer to change the permitted stop time period.

* * * * *